US006832432B2

(12) United States Patent
Bald et al.

(10) Patent No.: US 6,832,432 B2
(45) Date of Patent: Dec. 21, 2004

(54) HOT-ROLLING MILL

(75) Inventors: Wilfried Bald, Hilchenbach (DE); Dieter Rosenthal, Niederfischbach (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 10/107,883

(22) Filed: Mar. 27, 2002

(65) Prior Publication Data

US 2002/0095764 A1 Jul. 25, 2002

Related U.S. Application Data

(63) Continuation of application No. 08/980,078, filed on Nov. 26, 1997, now abandoned.

(30) Foreign Application Priority Data

Nov. 28, 1996 (DE) ..... 196 49 295

(51) Int. Cl.[7] ..... B23P 25/00

(52) U.S. Cl. ..... 29/527.7; 29/33 C; 164/417; 164/476

(58) Field of Search ..... 29/527.7, 33 C; 164/417, 476

(56) References Cited

U.S. PATENT DOCUMENTS 5,075,953 A * 12/1991 Braud ..... 29/527.7
5,115,547 A * 5/1992 Rohde ..... 29/33 C
5,121,873 A * 6/1992 Sekiya et al. ..... 228/170
5,467,519 A * 11/1995 Tippins et al. ..... 29/527.7
5,611,232 A * 3/1997 Rohde et al. ..... 29/527.7
5,787,565 A * 8/1998 Matsuo et al. ..... 29/527.7

* cited by examiner

*Primary Examiner*—Irene Cuda-Rosenbaum
(74) *Attorney, Agent, or Firm*—Friedrich Kueffner

(57) ABSTRACT

A hot-rolling mill for flat products with at least two continuous casting units, wherein the continuous casting units are followed by a shear each and a tunnel furnace with transfer car each, a common breaking-down train, a finishing train, a cooling stretch and at least one reeling device. A connecting device is arranged between the tunnel furnaces and the breaking-down train for connecting the continuously cast slabs which have been cut into the desired coil weights.

5 Claims, 2 Drawing Sheets

HOT-ROLLING MILL

This application is a Continuation Application of U.S. patent application Ser. No. 08/980,078, filed Nov. 26, 1997 now abandoned.

BACKGROUND OF THE INVENTION

1. Field of the Invention

The present invention relates to a hot-rolling mill for flat products with at least two continuous casting units, wherein the continuous casting units are followed by a shear each and a tunnel furnace with transfer car each, a common breaking-down train, a finishing train, a cooling stretch and at least one reeling device.

2. Description of the Related Art

Hot-rolling mills of the above-described type are already known in the art. These hot-rolling plants include reels, for example, coil boxes and possibly reeling furnaces, arranged between the breaking-down train and the finishing train; in the reels, the preliminary strips which have been rolled in the breaking-down train and correspond to the desired coil weights are coiled and possibly maintained at or heated to rolling temperature in order to then be uncoiled and fed to the finishing train. If small strip thicknesses are to be rolled in the finishing train, it has been found that it is very difficult to feed the rolled strip into the last stands of the finishing train because the thin strip is very difficult to guide and easily buckles. In the following cooling stretch, the thin strip can also easily lift off from the cooling bed because of the high speeds at which the strip travels, which results in buckling, back-ups and possibly interruptions of the process.

Accordingly, it has already been proposed in the art to crop the ends of the preliminary strips after the reel or the coil box or the reeling furnace, and to connect the end of a preliminary strip to the also cropped beginning of the subsequent preliminary strip, so that endless rolling is possible in the finishing train and the continuously recurring feeding procedures in the stands are not required.

However, this known type of plant has the disadvantage that the respective front ends and rear ends of the preliminary strip must be cropped in order to be able to produce problem-free connections, which always produces large quantities of scrap. In addition, a complicated reeling unit is required between the breaking-down train and the finishing train with at least one coiling reel and at least two uncoiling reels which substantially increases the costs of the total plant.

SUMMARY OF THE INVENTION

Therefore, it is the primary object of the present invention to further develop a hot-rolling mill of the above-described type in such a way that the rolling stock can be rolled endlessly and inexpensively without producing scrap.

In accordance with the present invention, a connecting device is arranged between the tunnel furnaces and the breaking-down train for connecting the continuously cast slabs which have been cut into the desired coil weights.

The cutting shears following the continuous casting units carry out exact, smooth cuts, so that the beginning as well as the end of each transversely cut slab can be connected without problems to additional slabs of the additional casting unit which have also been transversely cut, without requiring cropping cuts. The transversely cut slabs are alternatingly moved by means of the transfer cars into the rolling line and the slabs are connected to each other by the connecting device arranged in front of the breaking-down train without producing any scrap. In addition, the feeding speed of the rolling stock is lower in front of the breaking-down train than the feeding speed of the rolling stock in front of the finishing train, so that the connecting device, which is moved synchronously with the rolling speed and is moved with the rolling stock, can operate at a lower speed.

Consequently, the connecting device according to the present invention has a shorter structural length than the known connecting device arranged in front of the finishing train, so that the entire length of the hot-rolling train is shorter and the costs of the plant are lower. In addition, the mill according to the present invention does not require the reeling unit following the breaking-down train which in the past had the purpose of compensating the differences between the rolling speed of the breaking-down train and the rolling speed of the finishing train and, thus, uncoupling the rolling process in the breaking-down train relative to the rolling process in the finishing train, so that the costs of the hot-rolling mill are even further reduced.

It has been found useful to arrange heating units between the connecting device and the breaking-down train and/or between the breaking-down train and the finishing train. The heating units make it possible to heat slabs which may have cooled down too much during the connecting procedure to the required temperature for the first pass in the breaking-down train. A heating unit arranged in front of the finishing train also serves to heat the strip, if necessary, to the temperature required for the first pass in the finishing train.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
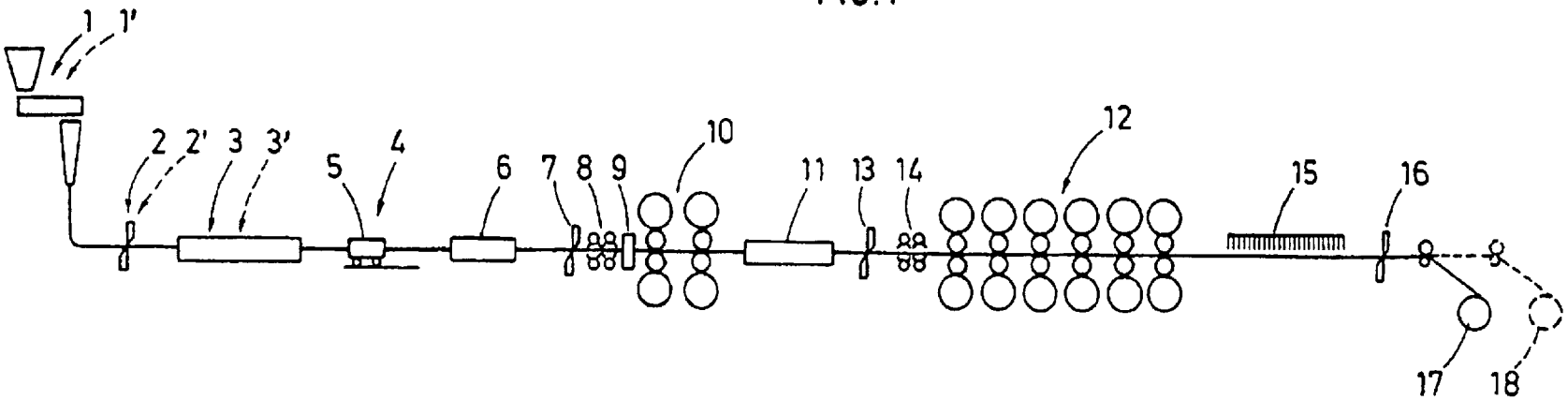
FIG. 1 is a schematic side view of the hot-rolling mill according to the present invention.
Figure 2:
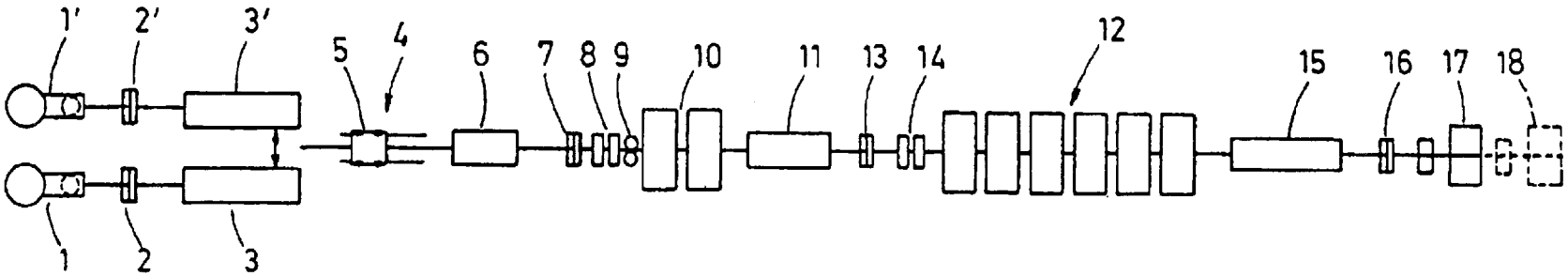
FIG. 2 is a top view of the hot-rolling mill according to the present invention.
Figure 3:
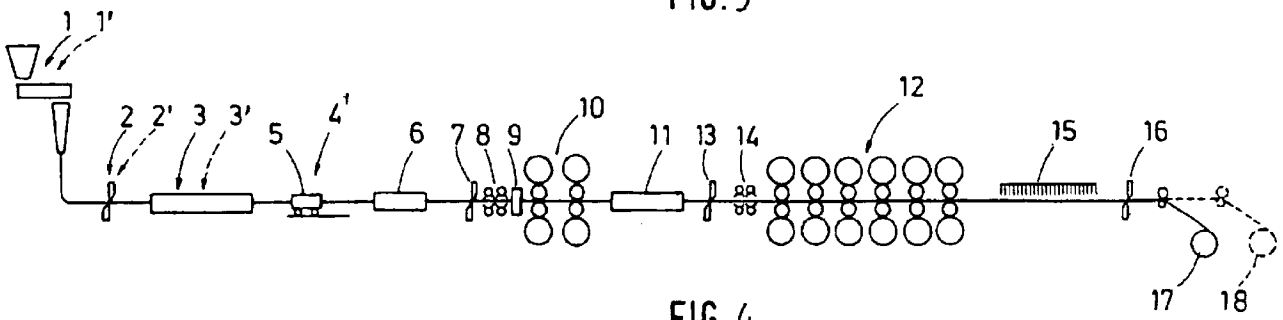
FIG. 3 is a view as in FIG. 1 of a second embodiment of the invention.
Figure 4:
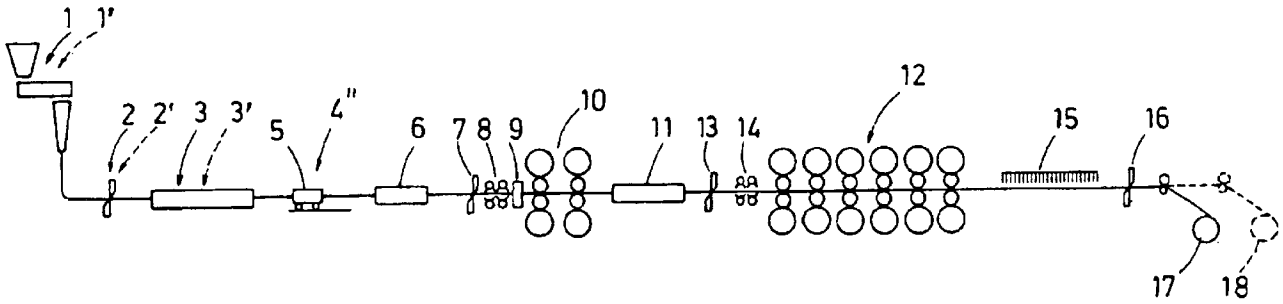
FIG. 4 is a view as in FIG. 1 of a third embodiment of the invention.
Figure 5:
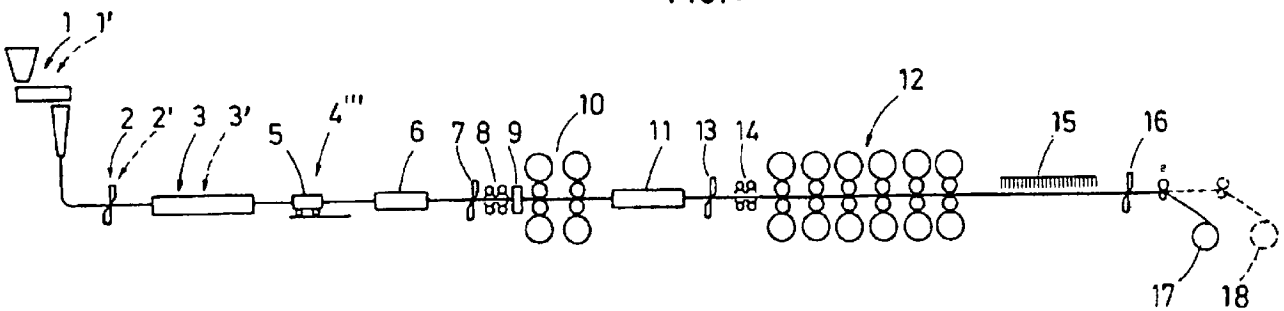
FIG. 5 is a view as in FIG. 1 of a fourth embodiment of the invention.

FIGS. 1 and 2 of the drawing show two continuous casting units 1, 1' arranged parallel to each other, followed by shears 2, 2', for example, oscillating shears or pendulum shears, for transversely cutting the continuously cast thin slabs. The continuous casting units 1, 1' supply tunnel furnaces 3, 3', wherein furnace cars, not shown, are provided in the tunnel furnaces 3, 3' for displacing into the rolling line the thin slabs which have been cut to length corresponding to the desired coil weights.

The tunnel furnaces 3, 3' are followed by a connecting device 4. The connecting device 4 includes a carriage 5 in which the end of a thin slab cut by the shear 2 or 2' is brought into contact with the beginning of the subsequent thin slab which has also been cut by the shear 2 or 2' and the two thin slabs are connected. For this purpose, the carriage 5 preferably has a welding device 4', a mechanical connecting device 4" or a forging press 4'" for connecting the slabs to each other.

The drawing further shows a heating device 6 for heating the thin slabs which have been connected to each to a temperature which is optimal for the following breaking-down rolling process. However, it must be pointed out that it is entirely possible to continuously cast, transversely cut, connect and subsequently breaking-down roll material qualities which do not require a heating device 6 in front of the breaking-down train 10.

The heating unit 6 is followed by a shear 7, descaling sprays 8, an upsetting device 9 and the breaking-down train 10. The breaking-down train 10 is followed by another heating device 11 in which the endlessly inserted preliminary strip can be heated to an optimum temperature for the following finishing train 12. Another shear 13 and descaling sprays 14 are arranged between the heating device 11 and the finishing train 12.

A cooling stretch 12 is provided at the exit of the finishing train 12 in which the strip can be rolled down to small final thicknesses. The endlessly rolled strip is then cut by means of the shears 16 to the lengths corresponding to the desired coil weights and is coiled by means of the reeling devices 17 or 18.

Because an endless rolling procedure is carried out, the strip only has to be inserted or fed into the finishing train at the beginning of the rolling procedure, so that problems in the finishing train 12 are avoided during the further course of the rolling procedure.

While specific embodiments of the invention have been shown and described in detail to illustrate the inventive principles, it will be understood that the invention may be embodied otherwise without departing from such principles.

We claim:

1. A method of hot-rolling finished products from rolling stock, the method comprising continuously casting thin slabs in at least two continuous casting units, cutting the thin slabs into desired lengths, feeding the thin slabs into tunnel furnaces and carrying out equalizing procedures in the tunnel furnaces, the tunnel furnaces including transfer cars for moving the thin slabs transversely of a rolling line, further comprising moving the thin slabs alternatingly from the at least two casting units into the rolling line, directly contacting and connecting the thin slabs in the rolling line following the tunnel furnaces without a crop cut, and subsequently subjecting the connected thin slabs endlessly to a breaking-down rolling procedure and a finish rolling procedure with a subsequent cooling procedure and coiling procedure.

2. The method according to claim 1, further comprising heating the connected thin slabs between the breaking-down procedure and the finish rolling procedure.

3. The method according to claim 1, comprising connecting the thin slabs by welding.

4. The method according to claim 1, comprising mechanically connecting the thin slabs.

5. The method according to claim 4, comprising using a forging press for mechanically connecting the thin slabs.

* * * * *